US005669399A

United States Patent [19]

Camp, Jr. et al.

[11] Patent Number: 5,669,399

[45] Date of Patent: Sep. 23, 1997

[54] HAIR FORMING DEVICE

[75] Inventors: Charles L. Camp, Jr.; John W. Lindley, Jr., both of Clyde, N.Y.

[73] Assignee: Hair Hoops, Inc., Rochester, N.Y.

[21] Appl. No.: 635,260

[22] Filed: Apr. 12, 1996

Related U.S. Application Data

[63] Continuation-in-part of Ser. No. 434,850, May 4, 1995, Pat. No. 5,555,901.

[51] Int. Cl.[6] ..... A45D 8/04

[52] U.S. Cl. ..... 132/273; 132/274

[58] Field of Search ..... 132/273, 274, 132/212, 201, 276, 275, 278; 446/48, 487; 273/153.5, 155; 59/78, 80, 83, 84; 63/4; D11/17, 15

[56] References Cited

U.S. PATENT DOCUMENTS

| | | | |
|---|---|---|---|
| 1,959,469 | 5/1934 | Gregory | 446/487 |
| 2,699,789 | 1/1955 | Goodman | 132/278 |
| 3,775,897 | 12/1973 | Soulakis et al. | 446/487 |
| 4,913,174 | 4/1990 | Cusenza | 132/273 |
| 5,100,356 | 3/1992 | Atwell | 446/48 |
| 5,156,023 | 10/1992 | Bevolo . | |
| 5,167,245 | 12/1992 | Harriett . | |
| 5,289,834 | 3/1994 | Lawrence . | |
| 5,293,884 | 3/1994 | Chapman et al. . | |
| 5,318,054 | 6/1994 | Neilson et al. . | |

*Primary Examiner*—Gene Mancene
*Assistant Examiner*—Philogene Pedro
*Attorney, Agent, or Firm*—M. Lukacher

[57] ABSTRACT

A hair forming device for arranging a pony tail or braid. The device comprises a series of rings disposed serially, and overlapping one another just enough to form a junction connecting adjacent rings. The rings may be arranged linearly, or in a matrix forming two series of rings abreast of one another. Teeth project outwardly from the rings, preferably located at the junctions between adjacent rings. The device is essentially planar, although having a nominal material thickness. Hair is preferably divided into two braids, each braid being passed through each ring. The novel device secures the braids in this manner, and is worn as long as the hair style thus achieved is maintained.

6 Claims, 2 Drawing Sheets

HAIR FORMING DEVICE

REFERENCE TO RELATED APPLICATION

This application is a Continuation-In-Part of Ser. No. 08/434,850, filed May 4, 1995, now U.S. Pat. No. 5,555,901.

BACKGROUND OF THE INVENTION

1. Field of the Invention

The present invention relates to an accessory for forming a decorative braid in long hair. The device provides a form or guide for constraining the braid to produce a specified configuration.

2. Description of the Prior Art

Adornment of a person's hair, and particularly adornment by tying long hair into braids and like configurations, has long been practiced. In an effort to create new styling effects, it has further been desired to provide hair shaping and controlling devices for influencing the final style or configuration of long hair and braids.

An example is seen in U.S. Pat. No. 5,318,054, issued to Kris Neilson et al. on Jun. 7, 1994. The apparatus shown therein comprises a coiled spring which forms a generally circular band. The spring has internal teeth for engaging the hair, and is held in place by the action of the spring. The coil surrounds a braid at one point along the length of the braid, and when in place, gives the visual impression of a solid, circular band. This device has a singular component, unlike the multiple circular bands of the present invention, and furthermore comprises a self-closing, openable loop. The loops of the present invention are permanently closed. The present invention has external teeth for engaging hair.

Another type of device is shown in U.S. Pat. No. 5,167,245, issued to Debra S. Harriett on Dec. 1, 1992. Harriett's device comprises an elongated, flexible member which is spiralled around a braid of hair, and suitably tied to itself. The device is employed in a conjunction with a needle having an eye. The associated method of use disclosed results in a single braid of hair which is encircled at various points along its length by the one flexible member. The device of Harriett is clearly different from the linked loops of the present invention.

U.S. Pat. No. 5,293,884, issued to R. David Chapman et al. on Mar. 15, 1994, describes a hair tie which encircles a braid one time along a limited length of the braid. The apparatus includes a generally rectangular patch of flexible material, which encircles the braid and is fastened in this position. The invention of Chapman et al. encircles the hair at a single point along the pony tail or braid. This device lacks the series of loops and external teeth provided in the present invention.

U.S. Pat. No. 5,289,834, issued to Lloyd D. Lawrence on Mar. 1, 1994, describes a flexible, elongated device for encircling a pony tail, and enabling the user of the device to manipulate the pony tail into a new configuration. The specified configuration is usually difficult for a person to achieve on his or her own hair, and the device makes this awkward task easier. Lawrence's device is removed from the pony tail or braid after the desired configuration is achieved. This configuration achieves an effect of passing the braid through itself. Hair does not pass through plural surrounding or retaining members, as is seen in the present invention. Also, Lawrence's device lacks external teeth present in the instant invention.

It will be noted that the devices of Harriett, Chapman et al., and Lawrence all share the common characteristic the principal component surrounding the braid is flexible, which is not the case in the present invention.

None of the above inventions and patents, taken either singly or in combination, is seen to describe the instant invention as claimed.

SUMMARY OF THE INVENTION

The present invention comprises a connected series of circular or otherwise configured rings, for passing a wearer's hair through and for maintaining the same in a specially styled configuration. The hair may be divided into any number of braids, each of which is passed through the individual rings of the hair styling device. This device is worn in the hair as long as the style is maintained, and is not removed. Thus, the device is a cosmetic hair accessory as well as an aid in maintaining hair in a desired configuration.

Individual rings overlap only to the extent that their associated ring members intersect and are joined to an adjacent ring member. Two adjacent ring members are thus connected, and will lie in parallel planes. Considered another way, two adjacent ring members form a figure eight. The assembly comprises, preferably, three or more rings similarly joined.

A series of external teeth for engaging the hair is disposed at the junction of adjacent rings. These teeth are symmetrically arranged about a hypothetical bisecting line disposed between two adjacent rings, to encourage hair to pull or weigh upon each ring equally. This assists in assuring that the novel device will not be urged to distort from its planar overall orientation.

A new styling effect is achieved, unlike the device of Harriett, and unlike the effect achieved by employing a number of unconnected rings which would be substantially axially aligned. The novel arrangement of rings alternately divides and combines two braids as they successively penetrate the series of rings. Thus, instead of maintaining the braid in a generally straight and cylindrical configuration, the rings connected in the novel arrangement promote a more dynamic visual effect.

A significant advantage of employing permanently closed rings is that once passed through a ring, a hair braid is then supported thereby. The wearer can concentrate on passing hair through the next ring, and need not devote effort to maintaining the hair in place. This situation is a potential deficiency of the device of Harriett, in that a spirally wrapped hair braid is not secured until the last spiral is completed, and the device is tied.

In an alternative embodiment, connection between adjacent rings is made not only serially, but at other positions also, thereby creating a matrix. The matrix embodiment shares the characteristic that rings are still located in parallel planes, so that braids continue to undergo periodic divisions. In a matrix, however, more than two parallel braids are accommodated.

Accordingly, it is a first object of the invention to provide a hair braid forming apparatus which has serially connected rings.

A second object of the invention is to provide a form for passing two hair braids through the form, alternately separating and combining the braids as they repeatedly pass through the form.

It is another object of the invention to have a matrix of connected rings.

It is a further object of the invention to orient the rings in parallel planes.

It is yet again an object of the invention to provide external teeth to better engage hair.

A still further object of the invention is to arrange the external teeth so that they will influence each adjacent ring equally.

Still another object of the invention is to provide a permanently joined assembly of rings.

An additional object of the invention is to provide the assembly of rings in an arrangement which enables two parallel paths for braids to be present.

It is again an object of the invention to maintain the braid in place merely by passing it through a ring, rather than by tying or otherwise securing the braid in place.

Yet another object of the invention is to provide a cosmetic hair accessory which also assists in forming or styling the hair.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
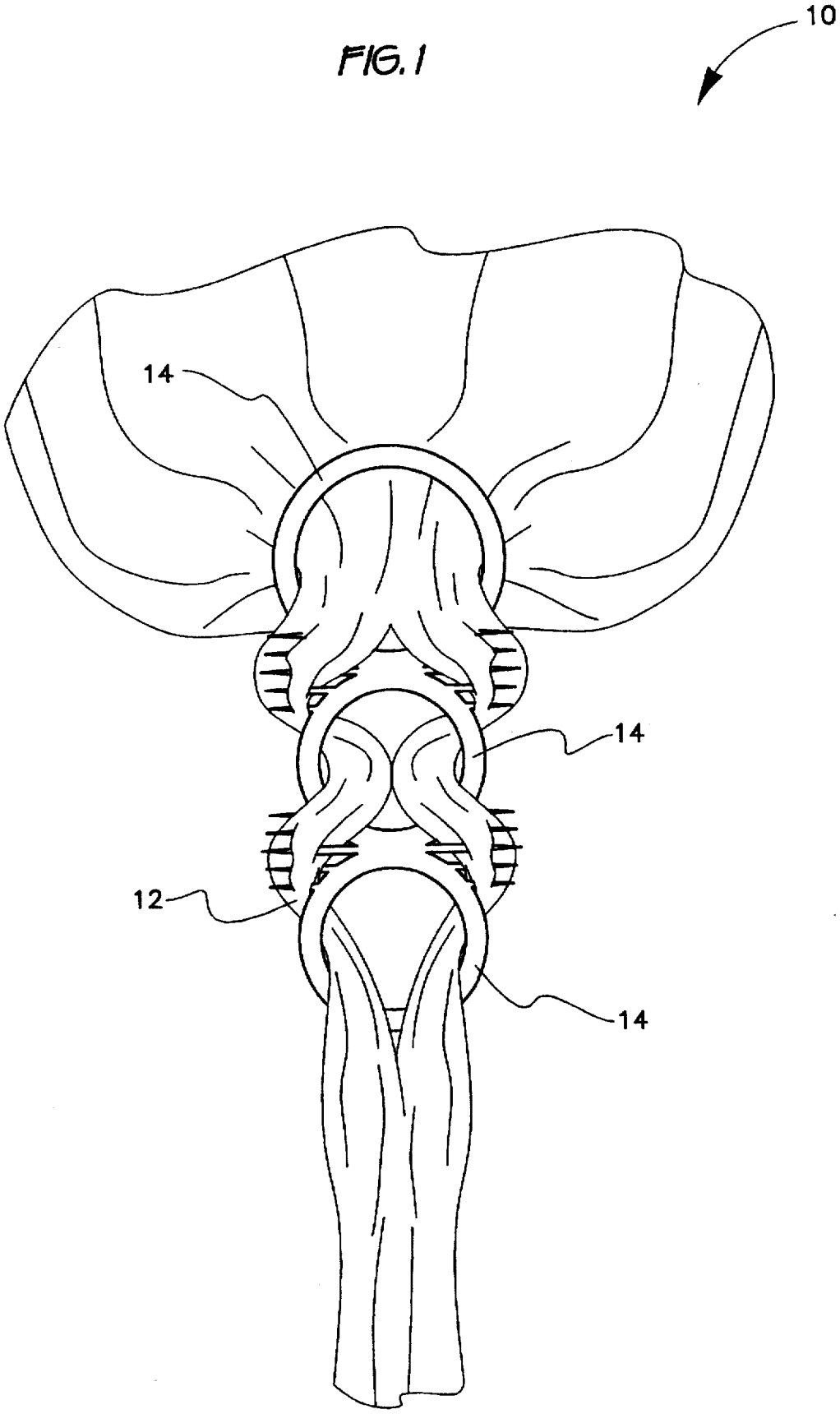
FIG. 1 is an environmental, top perspective view of the invention.

The novel hair forming device 10 is shown in FIG. 1 as it is worn by a person having with hair braids 12. Device 10 comprises a series of individual rings 14 connected at opposing ends.

Figure 2:
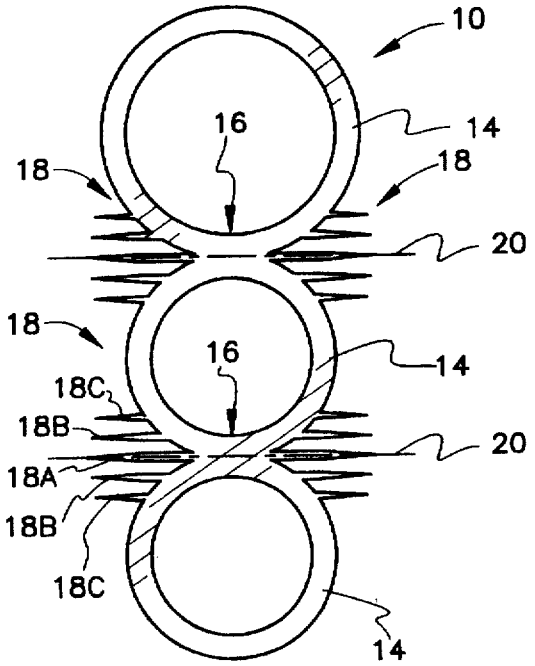
FIG. 2 is a top plan view of the preferred embodiment.

FIG. 2 shows the construction of device 10, which is formed as a unitary, single member. Device 10 is formed in any suitable way, such as by molding from a synthetic resin. Device 10 is essentially planar, although the material necessarily has a nominal thickness. Rings 14 are preferably disposed serially, thus forming a loop containing member, and are seen to overlap at junctions 16.

At the exterior of each junction 16 is a group of teeth 18 which project laterally from the loop member, and which are oriented to point externally of rings 14. Teeth 18 are preferably arranged parallel to and spaced apart from one another.

Teeth 18 have length dimensions selected so that the longest tooth 18A is located between two adjacent rings 14. Preferably, the longest tooth is aligned with a hypothetical line 20 bisecting an adjacent pair of rings 14, with adjacent teeth 18B, 18C being of progressively shorter length. Teeth 18 are disposed symmetrically about bisecting line 20 and are coplanar with respect to the loop member of device 10. This arrangement of teeth 18 maintains compactness of the overall dimensions of device 10 and presents a pleasing aesthetic appearance. This arrangement also generally causes teeth 18 to conform to a spherical cross section of a hair braid 12 as the braid 12 extends vertically across teeth 18 when passing through adjacent rings 14.

Figure 3:
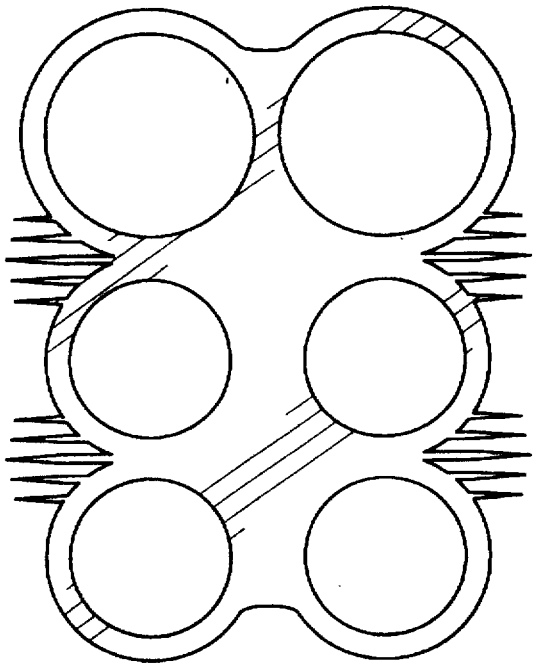
FIG. 3 is a top plan view of an alternative embodiment of the invention.

FIG. 3 illustrates an alternative embodiment wherein rings 14 form a matrix of rings disposed such that there are two linearly arranged columns of rings 14 disposed abreast of one another. This arrangement enables braids to pass through successive rings 14, but to remain separated from one another for aesthetic effect.

Figure 4:
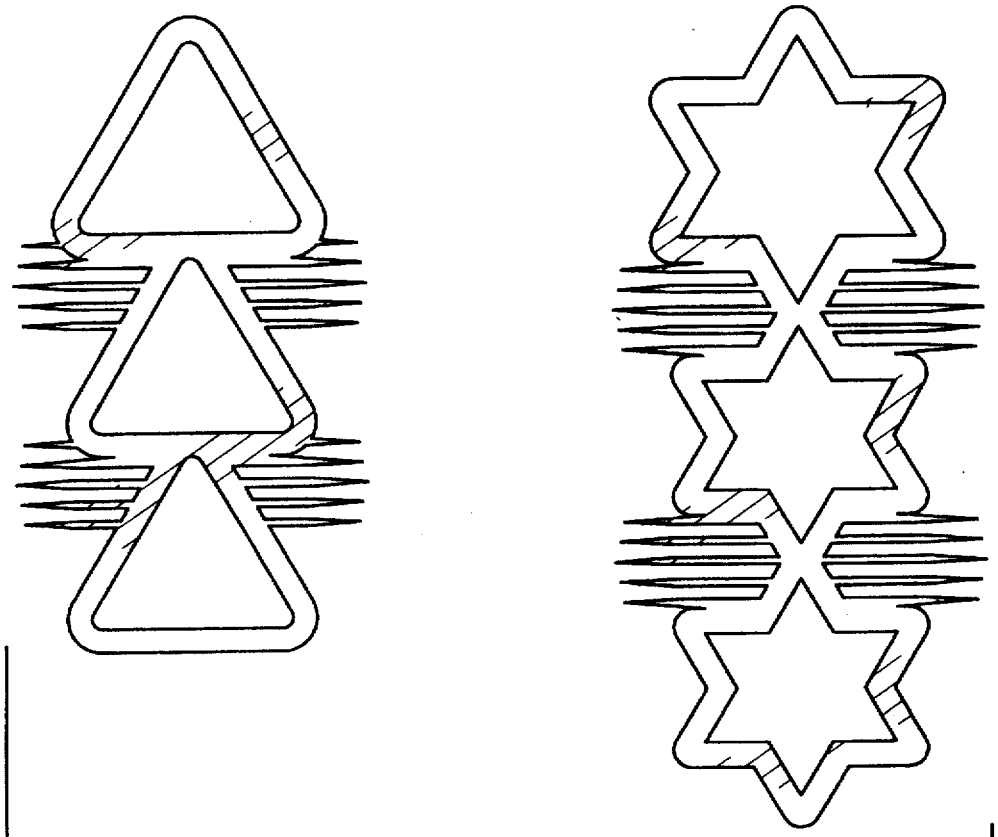
FIG. 4 is a top plan view illustrating variations in the configuration of each loop of the invention.

For purposes of retaining hair in braids 12, rings 14 must comprise closed loops. However, there is no requirement that the loops be circular. As illustrated in FIG. 4, rings 14 may be configured to form ovals, squares, triangles, hexagons, octagons, diamonds, and rectangles, among other geometric figures. Irregular shapes may also be employed, such as hearts, bows, and stars. For the purposes of communication, then, the term ring will be understood to encompass any shape forming a closed loop, whereby a hair braid is positively entrapped therein after being passed through the ring. In addition, elements of various embodiments may be mixed. Different shaped rings may be combined in one hair styling device.

In a preferred method of use, hair is gathered at the back of the head, and passed through the first ring 14. The hair is then divided into two braids 12, preferably of equal bulk. The right side braid 12 is passed through the next ring 14 on the right side, and the left side braid 12 is passed through the same next ring 14 on the left side. The braids 12 are then combined to pass through the third ring 14 in series. This process is repeated until the last ring 14 has been employed.

A new braiding style is thus created in which singular rings alternately divide and combine separate braids 12. In an alternative embodiment, braids 12 are separated.

It will be apparent to those of skill in the art that the present invention is susceptible to many variations and modifications. The precise arrangement of rings may be varied as desired, depending upon a desired configuration of hair braids. Also, teeth 18 may be of similar length.

It is to be understood that the present invention is not limited to the embodiments described above, but encompasses any and all embodiments within the scope of the following claims.

We claim:

1. A hair forming device, comprising:

a loop member further comprising a plurality of closed loops disposed serially; and a plurality of teeth projecting laterally and externally from said loop member.

2. The hair forming device according to claim 1, said plurality of teeth further comprising groups of teeth wherein individual said teeth are disposed parallel to and spaced apart from other said teeth within each said group of teeth.

3. The hair forming device according to claim 2, each one of said teeth having a length dimension of magnitude different from that of an adjacent said tooth.

4. The hair forming device according to claim 2, said loop member being planar, and having a bisecting line disposed between each pair of adjacent said closed loops, said teeth disposed symmetrically about said bisecting line and coplanar with respect to said loop member.

5. The hair forming device according to claim 4, each one of said teeth having a length dimension of magnitude different from that of an adjacent said tooth, one said tooth of greatest length dimension being disposed in alignment with said bisecting line, and each succeeding adjacent said tooth being of progressively shorter length.

6. A hair forming device, comprising:

a loop member further comprising a plurality of closed loops disposed serially; and at least one group teeth projecting laterally and externally from said loop member, teeth of each said group being disposed parallel to and spaced apart from other said teeth within an associated said group of teeth, each one of said teeth having a length dimension of magnitude different from that of an adjacent said tooth said loop member being planar, and having a bisecting line disposed between each pair of adjacent said closed loops, said teeth disposed symmetrically about said bisecting line and coplanar with respect to said loop member, one said tooth of greatest length dimension being disposed in alignment with said bisecting line, and each succeeding adjacent said tooth being of progressively shorter length.

* * * * *